US009798265B2

(12) United States Patent
Inoue et al.

(10) Patent No.: US 9,798,265 B2
(45) Date of Patent: Oct. 24, 2017

(54) LIQUID DEVELOPER

(71) Applicant: CANON KABUSHIKI KAISHA, Tokyo (JP)

(72) Inventors: Kei Inoue, Yokohama (JP); Kenji Nishiguchi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/166,666

(22) Filed: May 27, 2016

(65) Prior Publication Data

US 2016/0349654 A1 Dec. 1, 2016

(30) Foreign Application Priority Data

May 27, 2015 (JP) ..... 2015-107327
Mar. 7, 2016 (JP) ..... 2016-043372

(51) Int. Cl.

| | |
|---|---|
| ***G03G 9/12*** | (2006.01) |
| ***G03G 9/13*** | (2006.01) |
| ***G03G 9/125*** | (2006.01) |
| ***G03G 9/135*** | (2006.01) |
| *G03G 15/00* | (2006.01) |

(52) U.S. Cl.
CPC ..... *G03G 9/131* (2013.01); *G03G 9/125* (2013.01); *G03G 9/132* (2013.01); *G03G 9/1355* (2013.01); *G03G 15/00* (2013.01)

(58) Field of Classification Search
CPC .... G03G 9/1335; G03G 9/1355; G03G 9/131; G03G 9/132; G03G 9/125
USPC ..... 430/114, 115, 116
See application file for complete search history.

(56) References Cited

U.S. PATENT DOCUMENTS 4,170,563 A * 10/1979 Merrill ..... G03G 9/131 430/115
4,223,086 A * 9/1980 Merrill ..... G03G 9/131 430/119.1
4,917,986 A * 4/1990 Chan ..... G03G 9/1355 430/115
5,395,724 A * 3/1995 Morrison ..... G03G 9/12 430/114
5,407,775 A * 4/1995 Larson ..... G03G 9/122 430/115
5,409,796 A * 4/1995 Fuller ..... G03G 9/08704 430/114
5,441,841 A * 8/1995 Larson ..... G03G 9/1355 430/115
5,459,007 A * 10/1995 Larson ..... G03G 9/122 430/115
5,525,450 A * 6/1996 Spiewak ..... G03G 9/133 430/115
5,565,297 A * 10/1996 Larson ..... G03G 9/1355 430/114
5,573,882 A * 11/1996 Larson ..... G03G 9/133 430/115
5,641,346 A * 6/1997 Mantell ..... C09D 11/36 106/31.58
5,866,292 A * 2/1999 Chamberlain ..... G03G 9/131 430/115
8,377,616 B2 2/2013 Tani et al.
8,399,170 B2 3/2013 Iwase et al.
8,628,899 B2 1/2014 Kawamura et al.
2008/0026221 A1* 1/2008 Vincent ..... C09D 11/322 428/407

(Continued)

FOREIGN PATENT DOCUMENTS

EP 1884834 A1 2/2008
JP 06-208257 H 7/1994

(Continued)

OTHER PUBLICATIONS

English language machine translation of JP 2015-05494 (Mar. 2015).*

(Continued)

*Primary Examiner* — Christopher Rodee
(74) *Attorney, Agent, or Firm* — Fitzpatrick Cella Harper and Scinto

(57) ABSTRACT

The present invention can provide a liquid developer that can accommodate faster process speeds by image forming apparatuses, in which the liquid developer contains a toner particle comprising a polyester resin, and a carrier liquid having a vinyl ether compound. The liquid developer further contains a polymer compound having a structural unit represented by formula (1) in either of the toner particle or the carrier liquid.

(1)

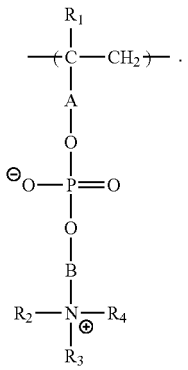

5 Claims, No Drawings

(56) References Cited

U.S. PATENT DOCUMENTS

| | | | | |
|---|---|---|---|---|
| 2009/0253067 | A1* | 10/2009 | Yoshie | G03G 9/08797 430/114 |
| 2010/0136474 | A1 | 6/2010 | Iwase et al. | |
| 2013/0078568 | A1* | 3/2013 | Inaba | G03G 9/135 430/112 |
| 2015/0192875 | A1* | 7/2015 | Ito | G03G 9/12 430/115 |
| 2015/0307734 | A1* | 10/2015 | Nonogaki | B41J 2/2107 347/20 |
| 2016/0130450 | A1* | 5/2016 | Ness | C09D 5/02 524/521 |

FOREIGN PATENT DOCUMENTS

| | | | |
|---|---|---|---|
| JP | 07-261467 | H | 10/1995 |
| JP | 07-319223 | H | 12/1995 |
| JP | 2002249684 | A * | 9/2002 |
| JP | 2003/241439 | A | 8/2003 |
| JP | 2015054949 | A * | 3/2015 |
| WO | 2006/126566 | A1 | 11/2006 |
| WO | 2007/000974 | A1 | 1/2007 |
| WO | 2007/000975 | A1 | 1/2007 |
| WO | 2007/108485 | A1 | 9/2007 |
| WO | WO 2016/190450 | A1 * | 12/2016 |

OTHER PUBLICATIONS

English language machine translation of JP 2002-249684 (Sep. 2002).*

Ishihara et al., "Preparation of Phospholipid Polymers and Their Properties as Polymer Hydrogel Membranes", Polymer Journal, vol. 22, No. 5, (1990) 355-60.

Willy Herbst, Industrial Organic Pigments: Production, Properties, Applications, 3rd ed. (2005) 637-45.

* cited by examiner

LIQUID DEVELOPER

BACKGROUND OF THE INVENTION

Field of the Invention

The present invention relates to a liquid developer for use in image forming apparatuses that utilize an electrophotographic system, for example, electrophotography, electrostatic recording, and electrostatic printing.

Description of the Related Art

An electrophotographic system is a method in which printed material is obtained by uniformly charging the surface of an image bearing member such as a photosensitive member (charging step), forming an electrostatic latent image by photoexposure of the surface of the image bearing member (photoexposure step), developing the thereby formed electrostatic latent image with a developer that contains colored particles (development step), transferring the developer image to a recording medium such as paper or plastic film (transfer step), and fixing the transferred developer image to the recording medium (fixing step).

The developers here are broadly classified into dry developers and liquid developers: colored particles constituted of a material that contains a binder resin and a colorant such as a pigment are used in a dry state in the former, while the colored particles are dispersed in an electrically insulating liquid in the latter.

The need for color output and high-speed printing from image forming apparatuses that use an electrophotographic system, e.g., copiers, facsimile machines, printers, and so forth, has been increasing in recent years. Within the realm of color printing, the demand for high-resolution, high-quality images has resulted in demand for developers that can accommodate high-speed printing while having the ability to form high-resolution, high-quality images.

Liquid developers are known to be developers that offer advantages with regard to color image reproducibility. With a liquid developer, the occurrence of aggregation by the colored particles in the liquid developer is suppressed, and due to this a microfine toner particle can be used. As a consequence, excellent properties with regard to the reproducibility of fine line images and the reproducibility of gradations are readily obtained with a liquid developer. Development is becoming quite active with regard to high-image-quality, high-speed digital printing apparatuses that exploit these excellent features by utilizing electrophotographic technologies that use liquid developers. In view of these circumstances, there is demand for the development of liquid developers that have even better properties.

Investigations have been carried out into various charge control agents for charging the toner particles in liquid developers and carrying out development by and transfer of the developer by electrophoresis.

For example, it is proposed in Japanese Patent No. 3,267,716 that low molecular weight compounds such as lecithin are effectively used as toner charge control agents that bring about negative charging by a toner.

In Japanese Patent Application Laid-open No. H7-319223, on the other hand, it is proposed that a polymer compound containing a quaternary ammonium salt functions as an effective negative-charging toner charge control agent.

In addition, Japanese Patent Application Laid-open No. H7-261467 indicates that an analogous polymer compound containing a quaternary ammonium salt, through its incorporation in the toner particle, functions as a charge adjuvant for causing the toner to undergo positive charging.

SUMMARY OF THE INVENTION

However, the toner charge control agents proposed to date are unsatisfactory as a consequence of the increasing process speeds of image forming apparatuses in recent years, and there is demand for the development of a toner charge control agent and a charge adjuvant that can bring about additional increases in toner particle electrophoretic mobility.

Accordingly, the present invention provides a toner charge control agent and a charge adjuvant that bring about additional increases in the amount of charge on the toner particle and in the toner particle electrophoretic mobility, and also provides a liquid developer that can accommodate increased process speeds for image forming apparatuses.

The present invention is a liquid developer that contains a toner particle and a carrier liquid, wherein the liquid developer contains a polymer compound having a structural unit represented by the following formula (1) in either the toner particle or the carrier liquid:

formula (1)

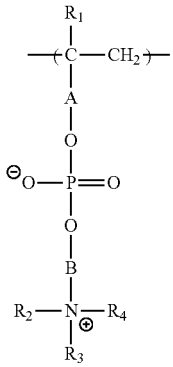

[In formula (1), $R_1$ to $R_4$ are independently selected from a hydrogen atom and an alkyl group; A is selected from a single bond, a carbonyl group, an alkylene group, an arylene group, and —$COOR_7$— (where the carbonyl group in the —$COOR_7$— is bonded to the carbon atom to which $R_1$ is bonded, and $R_7$ represents a $C_{1-4}$ alkylene group); and B is selected from an alkylene group and an arylene group.].

The present invention can provide a liquid developer that can accommodate faster process speeds by image forming apparatuses.

Further features of the present invention will become apparent from the following description of exemplary embodiments.

DESCRIPTION OF THE EMBODIMENTS

The present invention is described in detail in the following.

The liquid developer of the present invention is a liquid developer that contains a toner particle and a carrier liquid, wherein a polymer compound having a structural unit represented by the following formula (1) is contained in either the toner particle or the carrier liquid.

formula (1)

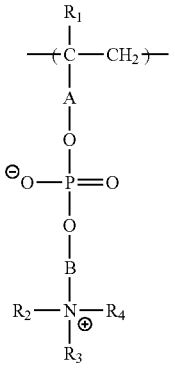

[In formula (1), $R_1$ to $R_4$ each independently represent either of a hydrogen atom and an alkyl group; A represents any of a single bond, a carbonyl group, an alkylene group, an arylene group, and —$COOR_7$— (where the carbonyl group in the —$COOR_7$— is bonded to the carbon atom to which $R_1$ is bonded, and $R_7$ represents a $C_{1-4}$ alkylene group); and B represents either of an alkylene group and an arylene group.]

The structural unit represented by formula (1) and the polymer compound having this structural unit are described in detail in the following.

The structural unit represented by formula (1) has an excellent positive charge acceptance capacity.

Thus, upon the dissolution or dispersion in the carrier liquid of the polymer compound having this structural unit, the polymer compound having this structural unit adsorbs to the toner particle and accepts positive charge from the toner particle. The toner particle charges to negative polarity as a result. Thus, the polymer compound having this structural unit functions as a toner charge control agent for causing the toner particle to undergo negative charging.

When, on the other hand, the toner particle contains the polymer compound having the indicated structural unit, the toner particle accepts positive charge, and the polymer compound having the indicated structural unit then acts as a charge adjuvant for causing the toner particle to undergo positive charging.

$C_{1-4}$ alkyl groups are preferred for the alkyl group for $R_1$ in formula (1). Examples here are the methyl group, ethyl group, n-propyl group, isopropyl group, and n-butyl group.

The $R_1$ in formula (1) can be freely selected from the hydrogen atom and the substituents indicated above, but is preferably the hydrogen atom or the methyl group from the standpoint of the production (polymerizability) of the polymer compound.

$C_{1-18}$ alkyl groups are preferred for the alkyl group for $R_2$ to $R_4$ in formula (1). Examples here are the methyl group, ethyl group, n-propyl group, isopropyl group, n-butyl group, n-octyl group, 2-ethylhexyl group, dodecyl group, and octadecyl group. These alkyl groups may also be substituted and may be bonded to each other to form a ring.

The A in formula (1) is a linking group that bonds the polymer main chain to the phosphate ester segment, and it represents any of a carbonyl group, an alkylene group, an arylene group, and —$COOR_7$— (where the carbonyl group in the —$COOR_7$— is bonded to the carbon atom to which $R_1$ is bonded, and $R_7$ represents a $C_{1-4}$ alkylene group). In addition, direct bonding to the polymer main chain may be carried out through a single bond.

The alkylene group encompassed by the linking group A may be linear chain or branched, and $C_{1-4}$ alkylene groups are preferred.

Examples here are the methylene group, ethylene group, propylene group, and the various butylene groups.

The arylene group encompassed by the linking group A can be exemplified by the 1,2-phenylene group, 1,3-phenylene group, 1,4-phenylene group, naphthalene-1,4-diyl group, naphthalene-1,5-diyl group, and naphthalene-2,6-diyl group.

With regard to the —$COOR_7$— encompassed by the linking group A, the carbonyl group in this —$COOR_7$— is bonded to the carbon to which $R_1$ is bonded, and $R_7$ is $C_{1-4}$ alkylene. This alkylene may be linear chain or branched.

These linking groups may also be substituted, and there is no particular limitation on this substitution as long as the charging characteristics of the polymer compound are not substantially lowered.

While the linking group A is not particularly limited among the preceding, it is more preferably a carbonyl group or —$COOR_7$— (where the carbonyl group in the —$COOR_7$— is bonded to the carbon atom to which $R_1$ is bonded, and $R_7$ represents a $C_{1-4}$ alkylene group) from the standpoint of ease of starting material acquisition and ease of production.

The B in formula (1) is a linking group that bonds the phosphate ester segment to the quaternary ammonium segment, and it represents either of an alkylene group and an arylene group.

The alkylene group encompassed by the linking group B may be linear chain or branched and is preferably a $C_{1-4}$ alkylene group.

Examples here are the methylene group, ethylene group, propylene group, and the various butylene groups.

The arylene group encompassed by the linking group B can be exemplified by the 1,2-phenylene group, 1,3-phenylene group, 1,4-phenylene group, naphthalene-1,4-diyl group, naphthalene-1,5-diyl group, and naphthalene-2,6-diyl group.

These linking groups may also be substituted, and there is no particular limitation on this substitution as long as the charging characteristics of the polymer compound are not substantially lowered.

While the linking group B is not particularly limited among the preceding, it is more preferably a simple alkylene group such as the methylene group and ethylene group from the standpoint of ease of starting material acquisition and ease of production.

Either the toner particle or the carrier liquid in the present invention preferably contains a copolymer having a structural unit represented by formula (1) and a structural unit represented by the following formula (2).

formula (2)

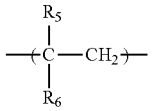

[In formula (2), $R_5$ represents either of a hydrogen atom and an alkyl group, and $R_6$ represents any of an alkyl group, a carboxylic acid ester group, a carboxylic acid amide group, an alkoxy group, and an aryl group.]

The alkyl group encompassed by $R_5$ in formula (2) is preferably a $C_{1-4}$ alkyl group. Examples here are the methyl group, ethyl group, n-propyl group, isopropyl group, and n-butyl group.

The $R_5$ in formula (2) can be freely selected from the hydrogen atom and the substituents indicated above, but is preferably the hydrogen atom or the methyl group from the standpoint of the production (polymerizability) of the copolymer.

The alkyl group for the $R_6$ in formula (2) is preferably a $C_{1-30}$ alkyl group. Examples here are the methyl group, ethyl group, n-propyl group, n-butyl group, n-hexyl group, n-decyl group, n-hexadecyl group, octadecyl group, docosyl group, and triacontyl group.

The aryl group for the $R_6$ in formula (2) can be exemplified by aryl groups such as the phenyl group, 1-naphthyl group, and 2-naphthyl group.

The carboxylic acid ester group encompassed by the $R_6$ in formula (2) can be exemplified by —$COOR_8$ (where $R_8$ is any of $C_{1-30}$ alkyl groups, the phenyl group, and $C_{1-30}$ hydroxyalkyl groups). Specific examples are ester groups such as the methyl ester group, ethyl ester group, n-propyl ester group, isopropyl ester group, n-butyl ester group, tert-butyl ester group, octyl ester group, 2-ethylhexyl ester group, dodecyl ester group, octadecyl ester group, docosyl ester group, triacontyl ester group, phenyl ester group, and 2-hydroxyethyl ester group.

The carboxylic acid amide group encompassed by the $R_6$ in formula (2) can be exemplified by —CO—$NR_9R_{10}$ (where $R_9$ and $R_{10}$ each independently represent any of hydrogen, $C_{1-30}$ alkyl groups, and the phenyl group). Specific examples are amide groups such as the N-methylamide group, N,N-dimethylamide group, N,N-diethylamide group, N-isopropylamide group, N-tert-butylamide group, N-n-decylamide group, N-n-hexadecylamide group, N-octadecylamide group, N-docosylamide group, N-triacontylamide group, and N-phenylamide group.

The alkoxy group for $R_6$ in formula (2) can be exemplified by $C_{1-30}$ alkoxy groups and $C_{1-30}$ hydroxyalkoxy groups. Specific examples are alkoxy groups such as the methoxy group, ethoxy group, n-propoxy group, isopropoxy group, n-butoxy group, n-hexyloxy group, cyclohexyloxy group, n-octyloxy group, 2-ethylhexyloxy group, dodecyloxy group, octadecyloxy group, docosyloxy group, triacontyloxy group, and 2-hydroxyethoxy group.

The $R_6$ substituent in formula (2) may also be substituted, and there is no particular limitation on this as long as the charging characteristics of the copolymer are not substantially lowered. The substituent that may be introduced in this case can be exemplified by alkoxy groups such as the methoxy group and ethoxy group, amino groups such as the N-methylamino group and N,N-dimethylamino group, acyl groups such as the acetyl group, and halogen atoms such as the fluorine atom and chlorine atom.

The $R_5$ and $R_6$ in formula (2) may be freely selected from the substituents indicated above, but appropriate substituents should be selected in conformity to the application for which the copolymer will be used.

For example, in the case of use as a toner charge control agent that is dissolved or dispersed in a low-polarity carrier liquid, the substituents are preferably selected so as to have a long-chain alkyl group in order to improve the solubility in the carrier liquid or improve the dispersibility and capacity to form a reverse micelle.

In the case, on the other hand, of incorporation in the toner particle as a charge adjuvant, the substituents are preferably selected so as to lower the solubility in the carrier liquid and improve the affinity with the binder resin.

The copolymerization composition ratio for the aforementioned copolymer is not particularly limited in the present invention, but the molar ratio of the structural unit represented by formula (1) to the structural unit represented by formula (2) is preferably 0.01:99.99 to 50:50 and is more preferably 1:99 to 30:70.

When the copolymerization composition ratio is in the indicated range, the function as a charge control agent or charge adjuvant is then thoroughly expressed and in addition an excellent solubility or dispersibility in the carrier liquid is exhibited and an excellent affinity for the binder resin is also exhibited.

The weight-average molecular weight (Mw) of the aforementioned polymer compound or copolymer is not particularly limited, and the molecular weight should be selected as appropriate in conformity to the use application.

For example, in the case of use dissolved or dispersed in the carrier liquid as a toner charge control agent, the weight-average molecular weight (Mw) is preferably approximately at least 3,000 and not more than 300,000 and is more preferably at least 3,000 and not more than 150,000.

When the Mw exceeds 300,000, the solubility or dispersibility in the carrier liquid declines and the functionality as a toner charge control agent assumes a declining trend.

In the case of incorporation in the toner particle as a charge adjuvant, the Mw is preferably at least 3,000 and not more than 300,000 and is more preferably at least 3,000 and not more than 150,000.

When the Mw is less than 3,000, elution from the toner particle into the carrier liquid becomes prominent and the functionality as a charge adjuvant assumes a declining trend. When, on the other hand, the Mw exceeds 300,000, the compatibility with and/or dispersibility in the binder resin assumes a declining trend.

With regard to the content of the polymer compound or copolymer for the liquid developer of the present invention, the structural unit represented by formula (1) is preferably at least 10 nmol % and not more than 0.1 mmol % with reference to the unit mass of the toner particle.

Having the content be in the indicated range makes it possible to obtain a desirable electrophoretic mobility and amount of charge for the toner particle and also facilitates maintenance of the electrical resistance of the liquid developer and avoids an influence on, for example, the developing performance and transferability.

When, on the other hand, the polymer compound or copolymer is dissolved or dispersed in the carrier liquid in the liquid developer of the present invention, the content is desirably approximately at least 0.01 mass parts and not more than 10 mass parts per 100 mass parts of the toner particle (solids fraction).

In addition, when the toner particle contains the polymer compound or copolymer, the content is desirably approximately at least 0.01 mass % and not more than 10 mass % with reference to the toner particle (solids fraction).

Methods for producing the polymer compound and the copolymer (also collectively referred to as the polymer compound in the following) are described in detail in the following.

There is no particular limitation on the method of producing the polymer compound as long as a polymer compound with the structure indicated above is obtained, but production can be carried out, for example, by the following methods.

Thus, production can be carried out by (i) a production method in which a vinyl monomer corresponding to formula (1) is produced followed by its polymerization, or (ii) a method in which a polymer compound corresponding to the polymer main chain of formula (1) is synthesized followed by bonding the zwitterion segment of formula (1) by a polymer reaction.

Production by the method given in (i) is preferred from the standpoint of ease of monomer acquisition and control of the amount of functional group. The method given in (i) is described in detail in the following.

Depending on the substituent $R_1$ and the structure of the linking group A, for example, a vinyl ether derivative, acrylate derivative, methacrylate derivative, α-olefin derivative, aromatic vinyl derivative, and so forth can be used as the vinyl monomer for introducing the structural unit represented by formula (1) into the polymer compound, while the use of an acrylate derivative or methacrylate derivative is preferred from the standpoint of ease of monomer production.

The corresponding acrylate derivative and methacrylate derivative can be produced, for example, by the method in the following article.

K. Ishihara and two others, "Polymer Journal", (published in Japan), The Society of Polymer Science, Japan, Volume 22, pp. 355-360 (1990).

The method of polymerizing this vinyl monomer can be exemplified by radical polymerization and ionic polymerization. Living polymerization can also be used with the goals of controlling the structure and controlling the molecular weight distribution. The use of radical polymerization is preferred industrially.

Radical polymerization can be carried out using a radical polymerization initiator, using exposure to radiation or light such as laser light, using a combination of a photoinitiator and exposure to light, and using the application of heat.

The radical polymerization initiator should be able to generate radicals and thereby start the polymerization reaction and is selected from compounds that can generate radicals through the action of heat, light, radiation, a redox reaction, and so forth.

Examples here are azo compounds, organoperoxides, inorganic peroxides, organometal compounds, and photoinitiators.

More specifically, examples here are azo compounds such as 2,2'-azobisisobutyronitrile (AIBN) and 2,2'-azobis(2,4-dimethylvaleronitrile); organoperoxides such as benzoyl peroxide (BPO), tert-butyl peroxypivalate, and tert-butyl peroxyisopropyl carbonate; inorganic peroxides such as potassium persulfate and ammonium persulfate; and redox initiators such as the hydrogen peroxide-iron(II) salt system, BPO-dimethylaniline system, and cerium(IV) salt-alcohol system. The photoinitiator can be exemplified by acetophenone types, benzoin ether types, and ketal types. Two or more of these radical polymerization initiators may be used in combination.

The polymerization temperature for this vinyl monomer is not particularly limited because the preferred temperature range will vary with the type of polymerization initiator used, but polymerization is generally carried out at a temperature of −30° C. to 150° C. while a more preferred temperature range is 40° C. to 120° C.

The use amount of the polymerization initiator used here is at least 0.1 mass parts and not more than 20 mass parts per 100 mass parts of the monomer, and the use amount is preferably adjusted so as to obtain a polymer compound having the target molecular weight distribution.

There are no particular limitations on the polymerization method here, and any method, e.g., solution polymerization, suspension polymerization, emulsion polymerization, dispersion polymerization, precipitation polymerization, bulk polymerization, and so forth, can be used.

The obtained polymer compound may as necessary be subjected to a purification treatment. There are no particular limitations on the purification method, and methods such as reprecipitation, dialysis, column chromatography, and so forth can be used.

The structure of the produced polymer compound can be identified using various instrumental methods of analysis. For example, nuclear magnetic resonance instrumentation (NMR), gel permeation chromatography (GPC), inductively coupled plasma optical emission spectrometric instrumentation (ICP-OES), and so forth can be used as the analytical instrumentation that can be used here.

The method of producing the aforementioned copolymer is also not particularly limited as long as a copolymer with the aforementioned structure is obtained, and is the same as described above for the polymer compound.

An example here is a method in which a vinyl monomer corresponding to formula (1) and a vinyl monomer corresponding to formula (2) are produced followed by production by their polymerization.

At this time, the polymerization may also be carried out with the further addition of a polymerizable monomer other than the vinyl monomer corresponding to formula (1) and the vinyl monomer corresponding to formula (2).

Each of the constituent components contained in the liquid developer of the present invention is described in the following.

The liquid developer of the present invention is constituted of at least a carrier liquid, a toner particle that is insoluble in the carrier liquid, and a polymer compound that contains a structural unit represented by formula (1).

The toner particle contains a binder resin and a colorant as constituent components.

The polymer compound is dissolved or dispersed in the carrier liquid when the polymer compound is used as a toner charge control agent. On the other hand, the polymer compound is contained in the toner particle when the polymer compound is used as a charge adjuvant.

The toner particle is dispersed in the carrier liquid in the liquid developer.

[The Carrier Liquid]

The carrier liquid should be a liquid that exhibits a high volume resistivity, electrical insulating properties, and a low viscosity around room temperature, but is not otherwise particularly limited.

Specific examples here are hydrocarbon solvents such as hexane, heptane, and octane; liquid paraffin solvents such as Isopar G, Isopar E, and Isopar L (Exxon Mobil Corporation) and Moresco White P-40 (Moresco Corporation); and silicone compounds.

The volume resistivity of the carrier liquid is preferably at least $1\times10^{9}$ Ω·cm and not more than $1\times10^{15}$ Ω·cm and is more preferably at least $1\times10^{1C}$ Ω·cm and not more than $1\times10^{15}$ Ω·cm.

A volume resistivity of less than $1\times10^{9}$ Ω·cm facilitates a drop in the potential of the electrostatic latent image and sets up a trend of impeding the generation of a high optical density and/or a trend of facilitating the occurrence of image blurring.

The volume resistivity is measured in the present invention by the impedance method.

Specifically, the measurement is carried out as follows using a dielectric measurement system (125596WB, Solartron ISA).

A measurement cell (SC-C1R-C, Toyo Corporation) filled with 1.2 mL of the sample is connected to the measurement instrument and adjustment to 25° C. is carried out. The measurement is carried out at an applied voltage of 3 V (effective value) while varying the frequency in the range from 1 MHz to 0.1 Hz. The obtained complex impedance is reported as a Nyquist plot, and the values of the resistive component and capacitive component of the sample are calculated by fitting with an equivalent RC parallel circuit. In addition, the volume resistivity is determined from the cell constant of the measurement cell.

The viscosity of the carrier liquid at 25° C., on the other hand, is preferably at least 0.5 mPa·s and less than 200 mPa·s and is more preferably at least 0.5 mPa·s and less than 100 mPa·s. An excessively high viscosity facilitates a decline in the electrophoretic mobility of the toner particle and sets up a declining trend for the print speed.

The viscosity is measured in the present invention by the rotational rheometer technique.

Specifically, the measurement is carried out as follows using a viscoelastic measurement instrument (Physica MCR300, Anton Paar GmbH).

Approximately 2 mL of the sample is filled into the measurement instrument fitted with a cone/plate measurement fixture (75 mm diameter, 1°) and adjustment to 25° C. is carried out. The viscosity is measured while continuously varying the shear rate from 1000 $s^{-1}$ to 10 $s^{-1}$, and the value at 10 $s^{-1}$ is used as the viscosity.

A polymerizable monomer may also be used in the carrier liquid in order to make the liquid developer of the present invention into an ultraviolet-curable type.

There are no particular limitations on the polymerizable monomer that can be used as long as the previously described characteristics of the carrier liquid are satisfied.

This polymerizable monomer can be exemplified by vinyl ether compounds, epoxy compounds, acrylic compounds, and oxetane compounds.

Vinyl ether compounds are preferred among the preceding from the standpoints of human safety, high resistance, and low viscosity.

A vinyl ether compound refers to a compound that has a vinyl ether structure (—CH═CH—O—C—).

This vinyl ether structure is preferably given by R—CH═CH—O—C— (R is hydrogen or $C_{1-3}$ alkyl and is preferably hydrogen or methyl).

In a preferred embodiment, the vinyl ether compound in the present invention is also a compound that does not contain a heteroatom outside the vinyl ether structure.

Here, "heteroatom" denotes an atom other than the carbon atom and hydrogen atom.

When a heteroatom is present in the vinyl ether compound, this facilitates the appearance of an intramolecular polarization of the electron density due to the difference between the electronegativity of the heteroatom and that of the carbon atom; also, the empty electron orbitals and/or unshared electron pairs possessed by the heteroatom can readily form pathways for conduction electrons or holes. A decline in the resistance is facilitated as a consequence.

In a preferred embodiment in the present invention, the vinyl ether compound also does not contain a carbon-carbon double bond outside of the vinyl ether structure in the vinyl ether compound. The carbon-carbon double bond has a high energy level occupied molecular orbital and a low energy level unoccupied molecular orbital, and these readily form a pathway for electrons and holes and then readily lead to a decline in the resistance. When a carbon-carbon double bond is present in the vinyl ether compound outside of the vinyl ether structure, a reduction in the resistance is facilitated by this mechanism.

The vinyl ether compound is preferably represented by the following general formula (C) in the present invention.

$$(H_2C{=}CH{-}O{-})_nR \qquad \text{formula (C)}$$

[In formula (C), n represents the number of vinyl ether structures in one molecule and is an integer from 1 to 4. R is an n-valent hydrocarbon group.]

n is preferably an integer from 1 to 3.

R preferably is a group selected from $C_{1-2C}$ linear-chain or branched, saturated or unsaturated aliphatic hydrocarbon groups, $C_{5-12}$ saturated or unsaturated alicyclic hydrocarbon groups, and $C_{6-14}$ aromatic hydrocarbon groups, and these alicyclic hydrocarbon groups and aromatic hydrocarbon groups may have a $C_{1-4}$ saturated or unsaturated aliphatic hydrocarbon group.

R is more preferably a $C_{4-18}$ linear-chain or branched saturated aliphatic hydrocarbon group.

This vinyl ether compound can be exemplified by n-octyl vinyl ether, 2-ethylhexyl vinyl ether, dodecyl vinyl ether, octadecyl vinyl ether, benzyl vinyl ether, dicyclopentadiene vinyl ether, cyclohexanedimethanol divinyl ether, tricyclodecane vinyl ether, trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentyl glycol divinyl ether, pentaerythritol tetravinyl ether, and 1,2-decanediol divinyl ether.

When the liquid developer of the present invention is made into an ultraviolet-curable type, the combination of a photoinitiator, a photopolymerization sensitizer, and a photopolymerization sensitizing aid may also be used with the polymerizable monomer. Any known compound can be used for the photoinitiator, photopolymerization sensitizer, and photopolymerization sensitizing aid as long as it does not cause an excessive decline in the volume resistivity of the liquid developer and does not bring about an excessive increase in the viscosity.

[Toner Charge Control Agent]

With the goal of adjusting the charging performance of the toner particle, an additional toner charge control agent may be present in the carrier liquid along with the aforementioned polymer compound.

The additional toner charge control agent that can be co-used here can be a known toner charge control agent within a range in which the volume resistivity of the liquid developer does not undergo an excessive decline and the viscosity of the liquid developer does not undergo an excessive increase.

Examples of specific compounds are as follows: fats and oils such as linseed oil and soy oil; alkyd resins; halogen polymers; aromatic polycarboxylic acids; acidic group-containing water-soluble dyes; oxidative condensates of aromatic polyamines; metal soaps such as zirconium naphthenate, cobalt naphthenate, nickel naphthenate, iron naphthenate, zinc naphthenate, cobalt octylate, nickel octylate, zinc octylate, cobalt dodecanoate, nickel dodecanoate, zinc dodecanoate, aluminum stearate, and cobalt 2-ethylhexanoate; metal sulfonates such as petroleum-based metal sulfonates and metal salts of sulfosuccinate esters; phospholipids such as lecithin; metal complexes of, for example, salicylic acid and benzilic acid; polyvinylpyrrolidone resins; polyamide resins; sulfonic acid-containing resins; and hydroxybenzoic acid derivatives.

When the aforementioned polymer compound is incorporated in the toner particle as a charge adjuvant in the present invention, a toner charge control agent is preferably added to the carrier liquid.

The added charge control agent is preferably a charge control agent that charges the toner particle to a positive sign, and a metal salt or metal complex of an organic acid is favorably used.

Specific examples are metal soaps such as zirconium naphthenate, cobalt naphthenate, nickel naphthenate, iron naphthenate, zinc naphthenate, cobalt octylate, nickel octylate, zinc octylate, cobalt dodecanoate, nickel dodecanoate, zinc dodecanoate, aluminum stearate, and cobalt 2-ethylhexanoate, as well as metal (for example, aluminum, chromium, zinc, zirconium, and boron) complexes of, for example, salicylic acid and benzilic acid.

The amount of addition in this case, expressed per 100 mass parts of the toner particle (solids fraction), is preferably at least 0.01 mass parts and not more than 10 mass parts and more preferably at least 0.05 mass parts and not more than 5 mass parts.

[The Toner Particle]

The toner particle contains a binder resin and a colorant as constituent components. In addition, the toner particle contains the polymer compound when the polymer compound is used as a charge adjuvant.

(Binder Resin)

A known binder resin can be used—as long as it is insoluble in the carrier liquid and exhibits a fixing performance for the adherend, e.g., paper or plastic film—as the binder resin present in the toner particle.

Here, this "insoluble in the carrier liquid" is provided as an indicator that not more than 1 mass parts of the binder resin dissolves at a temperature of 25° C. in 100 mass parts of the carrier liquid.

Specific examples of this binder resin are resins such as epoxy resins, polyester resins, (meth)acrylic resins, styrene-(meth)acrylic resins, alkyd resins, polyethylene resins, ethylene-(meth)acrylic resins, and rosin-modified resins. As necessary, a single one of these may be used or two or more may be used in combination.

There are no particular limitations on the content of the binder resin, but it is preferably 50 to 1,000 mass parts per 100 mass parts of the colorant.

[Colorant]

There are no particular limitations on the colorant incorporated in the toner particle, and, for example, any generally commercially available organic pigment, organic dye, inorganic pigment, or pigment dispersed in, e.g., an insoluble resin as a dispersion medium, or pigment having a resin grafted to its surface, can be used.

These pigments can be exemplified by the pigments described in, for example, "Industrial Organic Pigments", W. Herbst and K. Hunger.

The following are specific examples of pigments that present a yellow color:

C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C. I. Vat Yellow 1, 3, and 20.

Pigments that present a red or magenta color can be exemplified by the following:

C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, and 269; C. I. Pigment Violet 19; and C. I. Vat Red 1, 2, 10, 13, 15, 23, 29, and 35.

Pigments that present a blue or cyan color can be exemplified by the following:

C. I. Pigment Blue 2, 3, 15:2, 15:3, 15:4, 16, and 17; C. I. Vat Blue 6; C. I. Acid Blue 45; and copper phthalocyanine pigments in which the phthalocyanine skeleton is substituted by 1 to 5 phthalimidomethyl groups.

Pigments that present a green color can be exemplified by the following:

C. I. Pigment Green 7, 8, and 36.

Pigments that present an orange color can be exemplified by the following:

C. I. Pigment Orange 66 and 51.

Pigments that present a black color can be exemplified by the following:

carbon black, titanium black, and aniline black.

Pigments that present a white color can be exemplified by the following:

basic lead carbonate, zinc oxide, titanium oxide, and strontium titanate.

A dispersing means adapted to the toner particle production method may be used to disperse the pigment in the toner particle. Devices that can be used as this dispersing means are, for example, a ball mill, sand mill, attritor, roll mill, jet mill, homogenizer, paint shaker, kneader, agitator, Henschel mixer, colloid mill, ultrasonic homogenizer, pearl mill, wet jet mill, and so forth.

A pigment dispersing agent may also be added when pigment dispersion is carried out. The pigment dispersing agent can be exemplified by hydroxyl group-bearing carboxylic acid esters, the salts of long-chain polyaminoamides and high molecular weight acid esters, the salts of high molecular weight polycarboxylic acids, high molecular weight unsaturated acid esters, high molecular weight copolymers, modified polyacrylates, aliphatic polybasic carboxylic acids, naphthalenesulfonic acid/formalin condensates, polyoxyethylene alkyl phosphate esters, and pigment derivatives. The use of commercially available polymer dispersing agents such as the Solsperse series from The Lubrizol Corporation is also preferred.

A synergist adapted to the particular pigment may also be used as a pigment dispersing aid.

These pigment dispersing agents and pigment dispersing aids are added preferably at 1 to 50 mass parts per 100 mass parts of the pigment.

[Charge Adjuvant]

With the goal of adjusting the charging performance of the toner particle, an additional charge adjuvant may be incorporated in the toner particle along with the aforementioned polymer compound.

The additional charge adjuvant that can be co-used here can be a known charge adjuvant within a range in which the granulating properties for the toner particle and the pigment dispersibility in the toner particle do not undergo a substantial decline.

Examples of specific compounds are as follows: metal soaps such as zirconium naphthenate, cobalt naphthenate, nickel naphthenate, iron naphthenate, zinc naphthenate, cobalt octylate, nickel octylate, zinc octylate, cobalt dodecanoate, nickel dodecanoate, zinc dodecanoate, aluminum stearate, and cobalt 2-ethylhexanoate; metal sulfonates such as petroleum-based metal sulfonates and metal salts of sulfosuccinate esters; phospholipids such as lecithin; metal salts of salicylic acid, such as metal t-butylsalicylate complexes; polyvinylpyrrolidone resins; polyamide resins; sulfonic acid-containing resins; and hydroxybenzoic acid derivatives.

There are no particular limitations—as long as the charge adjuvant can be retained in the toner particle—on the method of incorporating the aforementioned polymer compound and the co-used additional charge adjuvant in the toner particle as charge adjuvants.

The following, for example, can be used: a method in which addition, along with, e.g., the binder resin and colorant, is carried out in the toner particle granulating step; a method in which, after toner particle granulation, bonding or adsorption to the toner particle surface is induced through a chemical or physical procedure. The optimal procedure should be selected from these procedures in conformity with the method of producing the liquid developer.

When the charge adjuvant added into the toner particle desorbs or detaches from the toner particle and dissolves or disperses in the carrier liquid, the volume resistivity of the liquid developer may be reduced and/or the action of the charge control agent present in the carrier liquid may be inhibited. Due to this, a structure should be selected that provides a reduced solubility in the carrier liquid and an enhanced affinity with the constituent materials of the toner particle.

In addition, when release of the charge adjuvant into the carrier liquid is substantial, a method can also be used in which the released charge adjuvant is removed from the carrier liquid using a technique such as, e.g., adsorption with an adsorbent, replacement of the carrier liquid, dialysis, and so forth.

[Other Additives]

In addition to those described above, various known additives may as necessary be used in the liquid developer of the present invention to respond to the goals of improving the compatibility with recording media, improving the storage stability, improving the image storability, and improving other characteristics. For example, the following can be selected as appropriate and used: surfactant, lubricant, filler, antifoaming agent, ultraviolet absorber, antioxidant, antifading agent, fungicide, anticorrosion agent, and so forth.

The method of producing the liquid developer in the present invention is not particularly limited and can be exemplified by known methods, for example, the coacervation method and the wet pulverization method.

An example of a general production method is a production method in which a pigment, a binder resin, other additives, and a dispersion medium are mixed; pulverization is carried out using, e.g., a bead mill, to obtain a dispersion of toner particles; and the obtained toner particle dispersion, a charge control agent, a carrier liquid, and so forth are mixed to obtain the liquid developer.

The details of the coacervation method are described in, for example, Japanese Patent Application Laid-open No. 2003-241439, WO 2007/000974, and WO 2007/000975.

In the coacervation method, a pigment, resin, solvent that dissolves the resin, and solvent that does not dissolve the resin are mixed and the solvent that dissolves the resin is then removed from the mixture to cause the resin that had been dissolved to precipitate, thereby creating a dispersion of pigment-enclosing toner particles in the solvent that does not dissolve the resin.

The details of the wet pulverization method, on the other hand, are described in, for example, WO 2006/126566 and WO 2007/108485.

In the wet pulverization method, the pigment and binder resin are kneaded at or above the melting point of the binder resin; this is followed by a dry pulverization; and the obtained pulverized material is subjected to a wet pulverization in an electrically insulating medium, thereby creating a dispersion of toner particles in the electrically insulating medium.

Known methods such as these can be used in the present invention.

Viewed from the perspective of obtaining a high-definition image, the volume-average particle diameter of the toner particle is preferably at least 0.05 μm and not more than 5 μm and is more preferably at least 0.05 μm and not more than 1 μm.

The toner particle concentration in the liquid developer in the present invention is desirably made approximately at least 1 mass % and not more than 70 mass %.

[Characteristics of the Liquid Developer]

The liquid developer of the present invention is preferably used having been prepared so as to have the following property values. Thus, viewed from the perspective of obtaining a suitable toner particle electrophoretic mobility, the viscosity of the liquid developer at 25° C. for a toner particle concentration of 2 mass % is preferably at least 0.5 mPa·s and not more than 100 mPa·s.

In addition, viewed from the perspective of not causing a drop in the potential of the electrostatic latent image, the volume resistivity of the liquid developer is preferably at least $1\times10^{9}$ Ω·cm and not more than $1\times10^{15}$ Ω·cm.

The measurement methods and evaluation methods used in the present invention are given in the following.

(1) Compositional Analysis

The following procedures were used for structural identification of the polymer compounds.

The $^{1}$H-NMR and $^{13}$C-NMR spectra were measured using an ECA-400 (400 MHz) from JEOL Ltd.

The measurements were carried out at 25° C. in a deuterated solvent containing tetramethylsilane as the internal standard. The chemical shift values were given as the shift value (δ value) in ppm assigning 0 to the tetramethylsilane internal standard.

(2) Measurement of the Molecular Weight Distribution

The molecular weight distribution of the polymer compounds was determined by gel permeation chromatography (GPC) as monodisperse polymethyl methacrylate. Measurement of the molecular weight by GPC was carried out as follows.

A solution was prepared by adding the sample to the eluent indicated below so as to provide a sample concentration of 1 mass % and holding for 24 hours at room temperature to effect dissolution. This solution was filtered across a solvent-resistant membrane filter having a pore diameter of 0.45 μm to give the sample solution, which was measured under the following conditions.

instrument: GPC-104 high-performance GPC (Showa Denko Kabushiki Kaisha)

column: GPC HFIP-603 and 604 (Showa Denko Kabushiki Kaisha)

eluent: hexafluoroisopropanol (HFIP) (contained 10 mmol/L sodium trifluoroacetate)

flow rate: 0.2 mL/min oven temperature: 40° C.

amount of sample injection: 20 μL

A molecular weight calibration curve constructed using polymethyl methacrylate resin standards (EasiVial PM Polymer Standard Kit, Agilent Technologies) was used for the determination of the molecular weight distribution of the sample.

(3) Measurement of the Volume-Average Particle Diameter

The volume-average particle diameter of the toner particles was measured in the corresponding carrier liquid using a particle size distribution analyzer based on dynamic light scattering (DLS) (product name: Nanotrac 150, Nikkiso Co., Ltd.).

(4) Evaluation of the Electrophoretic Mobility

Measurement of the electrophoretic mobility of the obtained liquid developers was carried out as follows.

A sample prepared by dilution with carrier liquid so as to provide a toner particle concentration of 1 mass %, was held by capillary force between parallel flat-plate electrodes consisting of metal electrodes with a thickness of 300 μm and a width of 20 mm facing each other across a gap of 100 μm.

The status of electrophoresis when a potential difference of 100 V (field strength=$1\times10^6$ V/m) was applied across the parallel flat-plate electrodes was photographed with a high-speed camera (FASTCAM SA-1, Photron Limited) connected to an optical microscope.

The obtained image was imported into ImageJ image processing software (developer: Wayne Rasband (NIH)), and the average electrophoretic mobility of the particles was calculated by the particle image velocimetry method (PIV method). The electrophoretic polarity of the particles was taken to be negative in the case of migration to the positive electrode and positive in the case of migration to the negative electrode.

The evaluation of the electrophoretic mobility was scored using the following criteria.

A: the average electrophoretic mobility was at least $1\times10^{-9}$ $m^2/V\cdot s$ B: the average electrophoretic mobility was at least $7\times10^{-1C}$ $m^2/V\cdot s$ and less than $1\times10^{-9}$ $m^2/V\cdot s$ C: the average electrophoretic mobility was at least $3\times10^{-1C}$ $m^2/V\cdot s$ and less than $7\times10^{-10}$ $m^2/V\cdot s$ D: the average electrophoretic mobility was at least $1\times10^{-1C}$ $m^2/V\cdot s$ and less than $3\times10^{-10}$ $m^2/V\cdot s$ E: the average electrophoretic mobility was less than $1\times10^{-1C}$ $m^2/V\cdot s$ When the average electrophoretic mobility was at least $7\times10^{-1C}$ $m^2/V\cdot s$ (rank A or B), the electrophoretic mobility and amount of charge were both high and this was therefore scored as excellent.

EXAMPLES

The present invention is specifically described in the following using examples, but the present invention is not limited to or by these examples. The "parts" in the examples refers to mass parts in all instances.

(Production of Polymer Compound a)

17.9 parts of 2-(methacryloyloxy)ethyl 2-(trimethylammonio)ethyl phosphate, 82.1 parts of octadecyl methacrylate, 4.1 parts of azobisisobutyronitrile, and 900 parts of n-butanol were introduced into a reactor fitted with a condenser, stirrer, thermometer, and nitrogen inlet tube and bubbling with nitrogen was carried out for 30 minutes. The obtained reaction mixture was heated for 8 hours at 65° C. under a nitrogen atmosphere to complete the polymerization reaction. The reaction solution was cooled to room temperature and the solvent was then distilled out under reduced pressure. The obtained residue was dissolved in chloroform and a dialytic purification was carried out using a dialysis membrane (Spectra/Por7 MWCO 1 kDa, Spectrum Laboratories, Inc.). The solvent was then distilled out under reduced pressure followed by drying at 50° C. under reduced pressure at 0.1 kPa or less to obtain the polymer compound a.

Analysis of the obtained polymer compound a by the analytic procedures indicated above confirmed that it had a weight-average molecular weight (Mw) of 11,800 and contained 21 mol % of the structural unit represented by formula (1) in the total monomer units.

(Production of Polymer Compound b)

A polymer compound b was produced proceeding as in the production of polymer compound a, but using 17.1 parts of 2-(acryloyloxy)ethyl 2-(trimethylammonio)ethyl phosphate in place of the 2-(methacryloyloxy)ethyl 2-(trimethylammonio)ethyl phosphate.

(Production of Polymer Compound c)

A polymer compound c was produced proceeding as in the production of polymer compound a, but using 20.5 parts of 2-(methacryloyloxy)ethyl 2-(triethylammonio)ethyl phosphate in place of the 2-(methacryloyloxy)ethyl 2-(trimethylammonio)ethyl phosphate.

(Production of Polymer Compound d)

A polymer compound d was produced proceeding as in the production of polymer compound a, but using 18.8 parts of 2-(methacryloyloxy)-1-methylethyl 2-(trimethylammonio)ethyl phosphate in place of the 2-(methacryloyloxy) ethyl 2-(trimethylammonio)ethyl phosphate.

(Production of Polymer Compound e)

A polymer compound e was produced proceeding as in the production of polymer compound a, but using 19.6 parts of 2-(methacryloyloxy)ethyl 1,2-dimethyl-2-(trimethylammonio)ethyl phosphate in place of the 2-(methacryloyloxy) ethyl 2-(trimethylammonio)ethyl phosphate.

(Production of Polymer Compound f)

A polymer compound f was produced proceeding as in the production of polymer compound a, but using 78.7 parts of octadecyl acrylate in place of the octadecyl methacrylate.

(Production of Polymer Compound g)

A polymer compound g was produced proceeding as in the production of polymer compound a, but using 48.1 parts of octyl methacrylate in place of the octadecyl methacrylate.

(Production of Polymer Compound h)

A polymer compound h was produced proceeding as in the production of polymer compound a, but using 34.5 parts of butyl methacrylate in place of the octadecyl methacrylate.

(Production of Polymer Compound i)

A polymer compound i was produced proceeding as in the production of polymer compound a, but using 136.4 parts of 2-(methacryloyloxy)ethyl 2-(dimethyldodecylammonio) ethyl phosphate in place of the 2-(methacryloyloxy)ethyl 2-(trimethylammonio)ethyl phosphate and octadecyl methacrylate.

(Production of Comparative Polymer Compound j)

A comparative polymer compound j was produced proceeding as in the production of polymer compound a, but using 12.6 parts of 2-(methacryloyloxy)ethyltrimethylammonium chloride in place of the 2-(methacryloyloxy)ethyl 2-(trimethylammonio)ethyl phosphate.

The compositional ratio and weight-average molecular weight (Mw) of the polymer compounds a to j produced as described above are given in Table 1. In Table 1, X represents the binding site with the polymer main chain in the structural unit represented by formula (1); X' represents the binding site with the phosphate ester segment in the structural unit represented by formula (1); Y represents the binding site with the phosphate ester segment in the structural unit represented by formula (1); Y' represents the binding site with the quaternary ammonium salt segment in the structural unit represented by formula (1); and Z represents the binding site with the polymer main chain in the structural unit represented by formula (2).

TABLE 1

Structure and properties of the polymer compounds

| Polymer compound | Polymer compound structure Formula (1) structure | | | | | |
|---|---|---|---|---|---|---|
| No. | $R_1$ | $R_2$ | $R_3$ | $R_4$ | A | B |
| Polymer compound a | $CH_3$ | $CH_3$ | $CH_3$ | $CH_3$ | 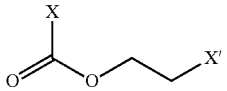 | Y—$CH_2CH_2$—Y' |
| Polymer compound b | H | $CH_3$ | $CH_3$ | $CH_3$ | 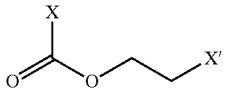 | Y—$CH_2CH_2$—Y' |
| Polymer compound c | $CH_3$ | $CH_2CH_3$ | $CH_2CH_3$ | $CH_2CH_3$ | 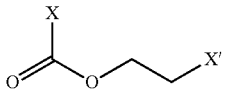 | Y—$CH_2CH_2$—Y' |
| Polymer compound d | $CH_3$ | $CH_3$ | $CH_3$ | $CH_3$ | 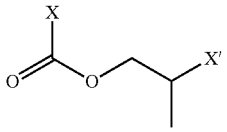 | Y—$CH_2CH_2$—Y' |
| Polymer compound e | $CH_3$ | $CH_3$ | $CH_3$ | $CH_3$ | 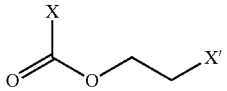 | —Y—CH($CH_3$)—CH($CH_3$)—Y' |
| Polymer compound f | $CH_3$ | $CH_3$ | $CH_3$ | $CH_3$ | 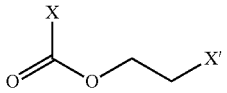 | Y—$CH_2CH_2$—Y' |
| Polymer compound g | $CH_3$ | $CH_3$ | $CH_3$ | $CH_3$ | 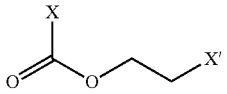 | Y—$CH_2CH_2$—Y' |
| Polymer compound h | $CH_3$ | $CH_3$ | $CH_3$ | $CH_3$ | 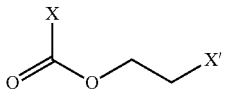 | Y—$CH_2CH_2$—Y' |
| Polymer compound i | $CH_3$ | $CH_3$ | $CH_3$ | $C_{12}H_{25}$ | 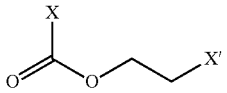 | Y—$CH_2CH_2$—Y' |
| Polymer compound j | | | | 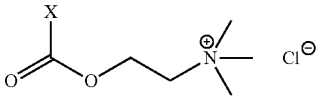 | | |

| Polymer compound | Polymer compound structure Formula (2) | | Compositional ratio (molar ratio) [formula (1): | |
|---|---|---|---|---|
| No. | $R_5$ | $R_6$ | formula (2)] | Mw |
| Polymer compound a | $CH_3$ | 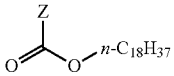 | 21:79 | 11800 |
| Polymer compound b | $CH_3$ | 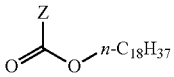 | 22:78 | 10300 |
| Polymer compound c | $CH_3$ | 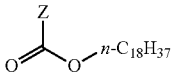 | 21:79 | 12500 |

TABLE 1-continued

| Structure and properties of the polymer compounds | | | | |
|---|---|---|---|---|
| Polymer compound d | $CH_3$ | 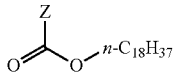 | 20:80 | 11100 |
| Polymer compound e | $CH_3$ | 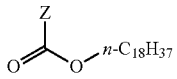 | 20:80 | 11400 |
| Polymer compound f | H | 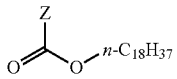 | 19:81 | 11000 |
| Polymer compound g | $CH_3$ | 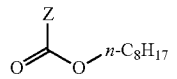 | 22:78 | 10100 |
| Polymer compound h | $CH_3$ | 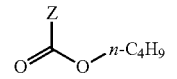 | 19:81 | 9800 |
| Polymer compound i | | No structure | — | 12300 |
| Polymer compound j | $CH_3$ | 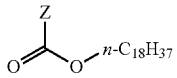 | 20:80 | 11500 |

Evaluation of the Polymer Compounds as Toner Charge Control Agents

Example 1

[Production of Toner Particle Dispersion]

25 parts of Nucrel N1525 (ethylene-methacrylic acid resin, Du Pont-Mitsui Polychemicals Co., Ltd.) and parts of Isopar L (Exxon Mobil Corporation) were introduced into a reactor equipped with a stirrer and a thermometer and the temperature was raised over 1 hour to 130° C. on an oil bath while stirring at 200 rpm. After holding for 1 hour at 130° C., gradual cooling was carried out at a ramp down rate of 15° C. per 1 hour to produce a binder resin dispersion. The obtained binder resin dispersion was a white paste.

60 parts of this binder resin dispersion, 5 parts of Pigment Blue 15:3, and 35 parts of Isopar L were filled into a planetary bead mill (Classic Line P-6, Fritsch) along with zirconia beads having a diameter of 0.5 mm, and pulverization was carried out at 200 rpm for 4 hours at room temperature to obtain a toner particle dispersion (solids fraction=20 mass %). The toner particles present in the obtained toner particle dispersion had a volume-average particle diameter of 0.85 μm.

[Preparation of Toner Charge Control Agent Dispersion]

6.2 parts of the polymer compound a and 68.2 parts of tetrahydrofuran (THF) were introduced into a reactor fitted with a stirrer and a thermometer and the temperature was raised to 60° C. and the polymer compound a was dissolved. After the introduction thereinto of 71.3 parts of Isopar L, the THF was distilled off at 50° C. under reduced pressure at 4 kPa to obtain a charge control agent dispersion as a transparent reverse-micelle liquid.

[Preparation of Liquid Developer]

0.125 parts of the toner charge control agent dispersion and 89.98 parts of Isopar L were mixed into 10.0 parts of the aforementioned toner particle dispersion to produce the liquid developer of Example 1.

Examples 2 to 9

The liquid developers of Examples 2 to 9 were produced proceeding as in Example 1, but using the polymer compounds b to i, respectively, in place of the polymer compound a.

Example 10

[Production of Binder Resin]

1500 parts of a bisphenol A/ethylene oxide adduct (Sigma-Aldrich) and 700 parts of terephthalic acid (Sigma-Aldrich) were introduced into a reactor that had been fitted with a reflux condenser, a water•alcohol separator, a nitrogen gas introduction conduit, a thermometer, and a stirrer, and a water-eliminating•alcohol-eliminating polycondensation reaction was run at a temperature of 200 to 240° C. while introducing nitrogen gas and stirring. After 1 hour, the temperature of the reaction system was lowered to 100° C. or below to stop the polycondensation. The obtained polyester resin had an Mw of 9,000, a number-average molecular weight (Mn) of 2,100, a glass transition temperature (Tg) of 68° C., and an acid value of 12.0 mg KOH/g.

In an ensuing step, the liquid developer of Example 10 was produced proceeding as in Example 1, but using the polyester resin produced as described above as the binder resin in place of the Nucrel N1525.

Example 11

The liquid developer of Example 11 was produced proceeding as in Example 1, but using dodecyl vinyl ether (Sigma-Aldrich) as the carrier liquid in place of the Isopar L.

Example 12

[Production of Toner Particle Dispersion]

A toner particle dispersion was produced proceeding as in Example 1, but using the polyester resin produced in Example 10 in place of the Nucrel N1525 and using dodecyl vinyl ether in place of the Isopar L.

[Preparation of Toner Charge Control Agent Dispersion]

A toner charge control agent dispersion was prepared proceeding as in Example 1, but using dodecyl vinyl ether in place of the Isopar L.

[Preparation of Liquid Developer]

0.125 parts of the toner charge control agent dispersion, 79.04 parts of dodecyl vinyl ether, and 9.68 parts of cyclohexanedimethanol divinyl ether were mixed into 10.0 parts of the aforementioned toner particle dispersion; this was followed by mixing and dissolving 0.29 parts of N-hydroxynaphthalimido-nonafluorobutanesulfonate as a photoinitiator, 0.48 parts of 2,4-diethylthioxanthone as a photopolymerization sensitizer, and 0.48 parts of 1,4-diethoxynaphthalene as a photopolymerization sensitizing aid to produce an ultraviolet-curable liquid developer. The composition of the carrier liquid in this liquid developer was designated "ultraviolet-curable vinyl ether mixture 1".

Example 13

[Preparation of Liquid Developer]

0.125 parts of the toner charge control agent dispersion produced in Example 12, 16.10 parts of dodecyl vinyl ether, and 72.63 parts of 2-butyl-2-ethyl-1,3-propanediol divinyl ether were mixed into 10.0 parts of the toner particle dispersion produced in Example 12; this was followed by mixing and dissolving 0.29 parts of N-hydroxynaphthalimido-nonafluorobutanesulfonate as a photoinitiator, 0.48 parts of 2,4-diethylthioxanthone as a photopolymerization sensitizer, and 0.48 parts of 1,4-diethoxynaphthalene as a photopolymerization sensitizing aid to produce an ultraviolet-curable liquid developer. The composition of the carrier liquid in this liquid developer was designated "ultraviolet-curable vinyl ether mixture 2".

The Isopar L had a volume resistivity of $8.4\times10^{13}$ Ω·cm and a viscosity at 25° C. of 1.2 mPa·s, and the dodecyl vinyl ether had a volume resistivity of $2.7\times10^{12}$ Ω·cm and a viscosity at 25° C. of 2.8 mPa·s. The cyclohexanedimethanol divinyl ether had a volume resistivity of $1.3\times10^{1C}$ Ω·cm and a viscosity at 25° C. of 4.2 mPa·s, and the 2-butyl-2-ethyl-1,3-propanediol divinyl ether had a volume resistivity of $9.4\times10^{12}$ Ω·cm and a viscosity at 25° C. of 2.7 mPa·s.

Comparative Example 1

The liquid developer of Comparative Example 1 was produced proceeding as in Example 1, but without using the polymer compound a that was used as the charge control agent.

Comparative Example 2

The liquid developer of Comparative Example 2 was produced proceeding as in Example 1, but using lecithin (soy-derived, Tokyo Chemical Industry Co., Ltd.) in place of the polymer compound a.

Comparative Example 3

The liquid developer of Comparative Example 3 was produced proceeding as in Example 1, but using the polymer compound j in place of the polymer compound a.

Table 2 below gives the results of the evaluation of the electrophoretic mobility of the liquid developers produced as described above.

TABLE 2

Results of the evaluation of the polymer compounds as toner charge control agents

| Example No. | Toner charge control agent | Binder resin | Carrier liquid | Electrophoretic polarity | Average electrophoretic mobility |
|---|---|---|---|---|---|
| Example 1 | Polymer compound a | ethylene-methacrylic acid resin | Isopar L | negative | A |
| Example 2 | Polymer compound b | ethylene-methacrylic acid resin | Isopar L | negative | A |
| Example 3 | Polymer compound c | ethylene-methacrylic acid resin | Isopar L | negative | A |
| Example 4 | Polymer compound d | ethylene-methacrylic acid resin | Isopar L | negative | A |
| Example 5 | Polymer compound e | ethylene-methacrylic acid resin | Isopar L | negative | A |
| Example 6 | Polymer compound f | ethylene-methacrylic acid resin | Isopar L | negative | A |
| Example 7 | Polymer compound g | ethylene-methacrylic acid resin | Isopar L | negative | A |
| Example 8 | Polymer compound h | ethylene-methacrylic acid resin | Isopar L | negative | A |
| Example 9 | Polymer compound i | ethylene-methacrylic acid resin | Isopar L | negative | B |

TABLE 2-continued

Results of the evaluation of the polymer compounds as toner charge control agents

| Example No. | Toner charge control agent | Binder resin | Carrier liquid | Electrophoretic polarity | Average electrophoretic mobility |
|---|---|---|---|---|---|
| Example 10 | Polymer compound a | polyester resin | Isopar L | negative | A |
| Example 11 | Polymer compound a | ethylene-methacrylic acid resin | dodecyl vinyl ether | negative | A |
| Example 12 | Polymer compound a | polyester resin | ultraviolet-curable vinyl ether mixture 1 | negative | A |
| Example 13 | Polymer compound a | polyester resin | ultraviolet-curable vinyl ether mixture 2 | negative | A |
| Comparative Example 1 | no addition | ethylene-methacrylic acid resin | Isopar L | clear migration not shown | |
| Comparative Example 2 | lecithin | ethylene-methacrylic acid resin | Isopar L | negative | E |
| Comparative Example 3 | Polymer compound j | ethylene-methacrylic acid resin | Isopar L | negative | C |

As is shown in Table 2, the addition of the polymer compounds a to i to the carrier liquid as a charge control agent is demonstrated to provide a liquid developer that gives an enhanced negative charging performance for the toner particle and a high electrophoretic mobility.

Evaluation of the Polymer Compounds as Charge Adjuvants

Example 14

[Toner Particle Production]

25 parts of Nucrel N1525 (ethylene-methacrylic acid resin, Du Pont-Mitsui Polychemicals Co., Ltd.) and parts of Isopar L (Exxon Mobil Corporation) were introduced into a reactor equipped with a stirrer and a thermometer and the temperature was raised over 1 hour to 130° C. on an oil bath while stirring at 200 rpm. After holding for 1 hour at 130° C., gradual cooling was carried out at a ramp down rate of 15° C. per 1 hour to produce a binder resin dispersion. The obtained binder resin dispersion was a white paste.

60 parts of this binder resin dispersion, 0.2 parts of polymer compound a as a charge adjuvant, 5 parts of Pigment Blue 15:3, and 35.8 parts of Isopar L were filled into a planetary bead mill (Classic Line P-6, Fritsch) along with zirconia beads having a diameter of 0.5 mm, and pulverization was carried out at 200 rpm for 4 hours at room temperature to obtain a toner particle dispersion (solids fraction=20 mass %). The toner particles present in the obtained toner particle dispersion had a volume-average particle diameter of 0.85 μm.

[Preparation of Toner Charge Control Agent Dispersion]

6.2 parts of an aluminum salicylate complex (Bontron E-108, Orient Chemical Industries Co., Ltd.) was mixed with 71.3 parts of Isopar L, and a charge control agent dispersion was obtained by then dispersing for 10 minutes at room temperature using an ultrasound homogenizer.

[Preparation of Liquid Developer]

The liquid developer of Example 14 was prepared by mixing 0.125 parts of the toner charge control agent dispersion and 89.98 parts of Isopar L into 10.0 parts of the aforementioned toner particle dispersion.

Example 15

The liquid developer of Example 15 was produced proceeding as in Example 14, but using a chromium salicylate complex (Bontron E-81, Orient Chemical Industries Co., Ltd.) as the toner charge control agent in place of the aluminum salicylate complex.

Example 16

The liquid developer of Example 16 was produced proceeding as in Example 14, but using a zinc salicylate complex (Bontron E-84, Orient Chemical Industries Co., Ltd.) as the toner charge control agent in place of the aluminum salicylate complex.

Example 17

The liquid developer of Example 17 was produced proceeding as in Example 14, but using a zirconium salicylate complex (TN-105, Hodogaya Chemical Co., Ltd.) as the toner charge control agent in place of the aluminum salicylate complex.

Example 18

The liquid developer of Example 18 was produced proceeding as in Example 14, but using a boron benzilate complex (LR-147, Japan Carlit Co., Ltd.) as the toner charge control agent in place of the aluminum salicylate complex.

Example 19

The liquid developer of Example 19 was produced proceeding as in Example 14, but using, as the toner charge control agent dispersion in place of the Isopar L dispersion of the aluminum salicylate complex, a solution prepared by dissolving 6.7 parts of zirconium naphthenate (Kishida Chemical Co., Ltd.) in 24.3 parts of Isopar L.

Example 20

The liquid developer of Example 20 was produced proceeding as in Example 14, but using the polyester resin produced in Example 10 as the binder resin in place of the Nucrel N1525.

Example 21

The liquid developer of Example 21 was produced proceeding as in Example 14, but using dodecyl vinyl ether (Sigma-Aldrich) as the carrier liquid in place of the Isopar L.

Example 22

The liquid developer of Example 22 was produced proceeding as in Example 14, but without using the aluminum salicylate complex that was used as the toner charge control agent.

Example 23

The liquid developer of Example 23 was produced proceeding as in Example 14, but using the polymer compound i as the charge adjuvant.

Example 24

[Production of Toner Particle Dispersion]

A toner particle dispersion was produced proceeding as in Example 14, but using the polyester resin produced in Example 10 as the binder resin in place of the Nucrel N1525 and using dodecyl vinyl ether as the carrier liquid in place of the Isopar L.

[Preparation of Toner Charge Control Agent Dispersion]

A toner charge control agent dispersion was prepared proceeding as in Example 14, but using dodecyl vinyl ether in place of the Isopar L.

[Preparation of Liquid Developer]

0.125 parts of the toner charge control agent dispersion, 79.04 parts of dodecyl vinyl ether, and 9.68 parts of cyclohexanedimethanol divinyl ether were mixed into 10.0 parts of the aforementioned toner particle dispersion; this was followed by mixing and dissolving 0.29 parts of N-hydroxynaphthalimido-nonafluorobutanesulfonate as a photoinitiator, 0.48 parts of 2,4-diethylthioxanthone as a photopolymerization sensitizer, and 0.48 parts of 1,4-diethoxynaphthalene as a photopolymerization sensitizing aid to produce an ultraviolet-curable liquid developer. The composition of the carrier liquid in this liquid developer was designated "ultraviolet-curable vinyl ether mixture 3".

Comparative Example 4

The liquid developer of Comparative Example 4 was produced proceeding as in Example 14, but without using the polymer compound a and without using the aluminum salicylate complex.

Comparative Example 5

The liquid developer of Comparative Example 5 was produced proceeding as in Example 14, but using lecithin (soy-derived, Tokyo Chemical Industry Co., Ltd.) in place of the polymer compound a.

Comparative Example 6

The liquid developer of Comparative Example 6 was produced proceeding as in Example 14, but using the polymer compound j in place of the polymer compound a.

Table 3 below gives the results of the evaluation of the electrophoretic mobility of the liquid developers produced as described above.

TABLE 3

Results of the evaluation of the polymer compounds as charge adjuvants

| Example No. | Charge adjuvant | Toner charge control agent | Binder resin | Carrier liquid | Electrophoretic polarity | Average electrophoretic mobility |
|---|---|---|---|---|---|---|
| Example 14 | Polymer compound a | aluminum salicylate complex | ethylene-methacrylic acid resin | Isopar L | positive | A |
| Example 15 | Polymer compound a | chromium salicylate complex | ethylene-methacrylic acid resin | Isopar L | positive | A |
| Example 16 | Polymer compound a | zinc salicylate complex | ethylene-methacrylic acid resin | Isopar L | positive | A |
| Example 17 | Polymer compound a | zirconium salicylate complex | ethylene-methacrylic acid resin | Isopar L | positive | A |
| Example 18 | Polymer compound a | boron benzilate complex | ethylene-methacrylic acid resin | Isopar L | positive | A |
| Example 19 | Polymer compound a | zirconium naphthenate | ethylene-methacrylic acid resin | Isopar L | positive | A |
| Example 20 | Polymer compound a | aluminum salicylate complex | polyester resin | Isopar L | positive | A |
| Example 21 | Polymer compound a | aluminum salicylate complex | ethylene-methacrylic acid resin | dodecyl vinyl ether | positive | A |

TABLE 3-continued

Results of the evaluation of the polymer compounds as charge adjuvants

| Example No. | Charge adjuvant | Toner charge control agent | Binder resin | Carrier liquid | Electrophoretic polarity | Average electrophoretic mobility |
|---|---|---|---|---|---|---|
| Example 22 | Polymer compound a | no addition | ethylene-methacrylic acid resin | Isopar L | positive | B |
| Example 23 | Polymer compound i | aluminum salicylate complex | ethylene-methacrylic acid resin | Isopar L | positive | B |
| Example 24 | Polymer compound a | aluminum salicylate complex | polyester resin | ultraviolet-curable vinyl ether mixture 3 | positive | A |
| Comparative Example 4 | no addition | no addition | ethylene-methacrylic acid resin | Isopar L | clear migration not shown | |
| Comparative Example 5 | lecithin | aluminum salicylate complex | ethylene-methacrylic acid resin | Isopar L | positive | E |
| Comparative Example 6 | Polymer compound j | aluminum salicylate complex | ethylene-methacrylic acid resin | Isopar L | positive | D |

As is shown in Table 3, the addition of polymer compounds a and i to the toner particle as a charge adjuvant is demonstrated to provide a liquid developer that gives an enhanced positive charging performance for the toner particle and a high electrophoretic mobility.

The present invention provides a toner charge control agent and a charge adjuvant that bring about additional increases in the amount of charge on the toner particle and in the toner particle electrophoretic mobility, and also provides a liquid developer that can accommodate increased process speeds for image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107327, filed May 27, 2015, Japanese Patent Application No. 2016-43372, filed Mar. 7, 2016, which are hereby incorporated by reference herein in their entirety.

What is claimed is:

1. A liquid developer comprising:

a toner particle that contains a polyester resin;

and a carrier liquid that contains a vinyl ether compound that has a volume resistivity of $1\times10^{9}$ to $1\times10^{15}$ Ω·cm, wherein the liquid developer contains a polymer compound having a structural unit represented by formula (1) in either the toner particle or the carrier liquid:

(1)

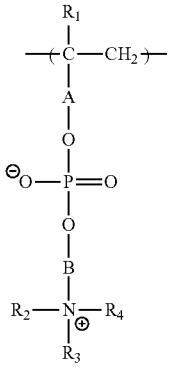

where $R_1$ to $R_4$ are independently selected from the group consisting of a hydrogen atom and an alkyl group; A is selected from the group consisting of a single bond, a carbonyl group, an alkylene group, an arylene group, and —$COOR_7$— (where the carbonyl group in the —$COOR_7$— is bonded to the carbon atom to which $R_1$ is bonded, and $R_7$ represents a $C_{1-4}$ alkylene group); and B is an alkylene group or an arylene group.

2. The liquid developer according to claim 1, wherein the carrier liquid contains the polymer compound having a structural unit represented by formula (1).

3. The liquid developer according to claim 1, wherein the carrier liquid contains a copolymer that has the structural unit represented by formula (1) and a structural unit represented by formula (2):

(2)

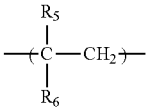

wherein $R_5$ is a hydrogen atom or an alkyl group, and $R_6$ is selected from the group consisting of an alkyl group, a carboxylic acid ester group, a carboxylic acid amide group, an alkoxy group, and an aryl group.

4. The liquid developer according to claim 1, wherein the toner particle contains the polymer compound having a structural unit represented by formula (1).

5. The liquid developer according to claim 4, wherein the carrier liquid contains a metal salt of an organic acid or a metal complex of an organic acid.

* * * * *